United States Patent [19]

Aslund et al.

[11] Patent Number: 4,584,170

[45] Date of Patent: Apr. 22, 1986

[54] METHOD OF MAKING PIPES BY POWDER METALLURGY AND PIPE BLANKS (SEMI-FINISHED PRODUCTS) MADE IN ACCORDANCE THEREWITH

[76] Inventors: Christer Aslund, Bruksgränd 14; Claes Tornberg, Staltappargatan 27, both of S-64400 Torshälla, Sweden

[21] Appl. No.: 668,295

[22] Filed: Nov. 5, 1984

[51] Int. Cl.[4] ..... B22F 7/00

[52] U.S. Cl. ..... 419/5; 419/8; 419/68; 419/69; 428/554; 428/558; 428/36

[58] Field of Search ..... 419/5, 6, 41, 8, 42, 419/48, 68, 69; 428/554, 558, 36

[56] References Cited

U.S. PATENT DOCUMENTS 4,486,385 12/1984 Aslund ..... 419/6

FOREIGN PATENT DOCUMENTS 3009916 3/1980 Fed. Rep. of Germany .
2492291 4/1982 France .

*Primary Examiner*—Stephen J. Lechert, Jr.
*Attorney, Agent, or Firm*—Andrus, Sceales, Starke & Sawall

[57] ABSTRACT

A method of making pipes by powder metallurgy, in which powder of metal and/or metal alloys (17) is filled into a thin-walled casing consisting of inner pipe wall (12), outer pipe wall (11) and a bottom (13), subsequently the casing is closed on its side remote from the bottom (13) by an annular cover (14) and is subjected to a cold-isostatic pressure whereby the powder (17) is compacted within the casing to produce a solid or dimensionally stable pipe blank or compact (10), which is then hot-worked, e.g. extruded. In order to prevent thermal cracks on the inner pipe or inner pipe wall (12), especially in the region of the ends thereof, the inner pipe or inner pipe wall (12) is provided prior to hot-working on at least one end region thereof with at least one circumferentially extending bulge (15 or 16, respectively).

8 Claims, 1 Drawing Figure

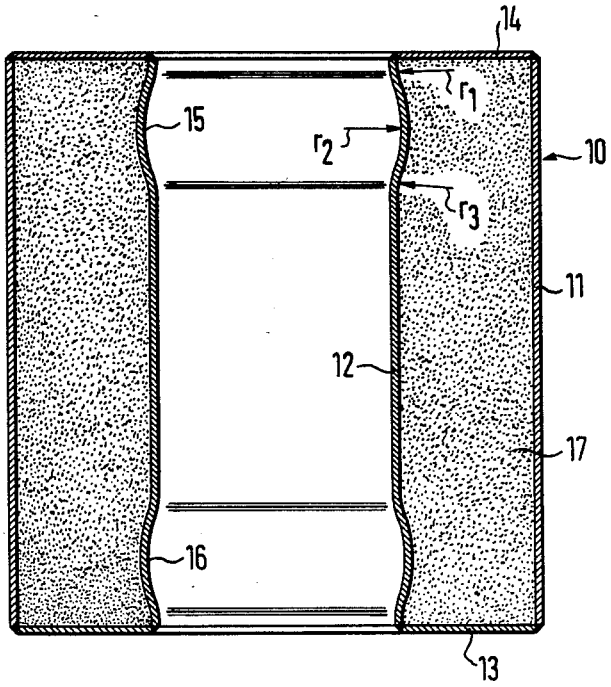
14
$r_1$
15
$r_2$
10
$r_3$
11
12
17
16
13

METHOD OF MAKING PIPES BY POWDER METALLURGY AND PIPE BLANKS (SEMI-FINISHED PRODUCTS) MADE IN ACCORDANCE THEREWITH

The invention is directed to a method of making pipes by powder metallurgy, in which powder of metal and/or metal alloys is filled into a thin-walled casing consisting of an inner casing wall, an outer casing wall and a bottom, whereupon the casing is closed by an annular cover on the side remote from the bottom and is subjected to a cold-isostatic pressure, thereby compacting the power within the casing so as to produce a solid or dimensionally stable pipe blank which is then hot-worked, viz., extruded while being heated.

Such a method has been known generally. However, it has been found that cracks due to thermal stresses frequently occur chiefly on the inner pipe or inner pipe wall, respectively, particularly on the two end regions, i.e., near the casing bottom and/or the casing cover. The cracks may extend either across the entire circumference of the inner pipe or inner pipe wall, respectively, or only across part thereof, depending on the magnitude of the thermal stresses.

It has been found that the cause of such crack formation is non-uniform heating of the pipe casing to the hot-working temperature. Such non-uniform heating occurs especially when large furnaces and relatively large pipe blanks or compacts are employed. For instance, it has been found that the thermal stresses may result in elongations especially of the inner pipe or inner pipe wall, respectively, amounting to 0.5 to 1% of the length of the pipe blank or compact.

The present invention is based on the object of preventing such crack formation during heating of the pipe blank to the hot-working temperature.

In accordance with the invention this object is solved in a surprisingly simple way by the characterizing measures of patent claim 1, wherein the features described in the subclaims, which relate to engineering and shaping measures, have been found to be especially advantageous.

Due to the bulge according to the invention it is possible to compensate or neutralize thermal stresses, wherein the bulge or bulges are provided at locations of maximum thermal stress, i.e., preferably in the end regions of the inner pipe or inner pipe wall, respectively.

The size of the bulge(s) according to the invention depends on the dimensions of the pipe blank and also, of course, on the hot-working temperature. The bulge(s) should be dimensioned such that the inner pipe or inner pipe wall, respectively, is practically completely smoothed out upon heating of the pipe blank or compact to the hot-working temperature. The expansion or elongation of the inner pipe caused by the differences in temperature may be calculated from the start on the basis of the following equation:

$$\Delta T\,(°C.) \times L_{pipe}\,(mm) \times \alpha \frac{1}{°C.}$$

where

ΔT: temperature difference expressed in °C.,

L: length of the pipe blank or compact expressed in (mm), and

α: coefficient of thermal expansion.

Preferably, the bulges extend radially outwardly and are formed by means of rollers or rolls or the like, wherein both male and female moulds may be employed.

It is highly significant that the bulges should have a "gentle or shallow curved shape", especially in the transitional regions between bulge and inner pipe or inner pipe wall, respectively. Thus, the bulge cross-section is somewhat trough-shaped, the radii of transition being approximately in the range of the radius of the inner pipe wall. The formation of folds should be prevented at all costs.

As explained above, the bulges according to the invention permit stretching or elongation of the inner pipe or inner pipe wall upon heating of the pipe blank or compact to the hot-working temperature without any problems, so that the inner pipe wall will be smoothed out.

With especially large pipe blanks it will be appropriate prior to the formation of the bulges to anneal the corresponding locations, e.g. the end regions of the inner pipe, and to remove the oxide layer formed thereby.

Below, a preferred embodiment of a pipe blank or compact configured and employed according to the invention will be described with reference to the accompanying drawing, which is a cross-section of a pipe blank or compact prior to hot-working. In the drawing

10 indicates the pipe blank or compact,

11 indicates the casing outer wall,

12 indicates the casing inner wall which is concentric with the casing outer wall,

13 indicates the annular casing bottom, and

14 indicates the annular casing cover.

Each end of the inner pipe or inner pipe wall 12 is formed with a radially outwardly extending bulge 15, 16 which permits thermal expansion of the inner pipe upon heating of the tubular casing 10 to the hot-working temperature such that the inner pipe wall 12 will be smoothed out. With longer and larger-sized tubular casings 10 it is possible to provide at each end two or more bulges corresponding to the bulges 15, 16 and extending across the circumference of the inner pipe or inner pipe wall. As will also be apparent from the drawing, the bulges 15, 16 have relatively shallow cross-sections, i.e., the radii of transition are relatively large and are within the range of the radius of the inner pipe wall 12.

The pipe blank or compact 10, which is heated to the hot-working temperature and has its inner pipe wall 12 smoothed out, may then be extruded in a conventional manner to form the final piping.

The depth and the radii of transition $r_1$, $r_2$ and $r_3$ depend on the dimensions of the pipe blank or compact 10, on the powder material used, on the material of inner pipe wall 12 and outer pipe wall 11, and on the hot-working temperature. Preferably, the bottom radius $r_2$ is twice as large as the radii of transition $r_1$ and $r_3$ in the transitional region between bulge and inner pipe.

All of the features disclosed in the application papers are claimed as being essential to the invention insofar as they are novel over the prior art either singly or in combination.

We claim:

1. A method of making pipes by powder metallurgy, in which powder of metal and/or metal alloys is filled into a thin-walled casing consisting of an inner pipe wall and an outer pipe wall and a bottom and wherein the casing is closed on the side remote from said bottom by means of an annular cover and is subjected to a cold-isostatic pressure, thereby producing a solid or dimensionally stable pipe blank which is then hot-worked such as being extruded while being heated, comprising a step prior to hot-working of forming the inner pipe at least in one end region with a least one circumferentially extending bulge (15 and 16, respectively), and thereafter hot-working of said blank with said bulge.

2. The method of claim 1, wherein said circumferentially extending bulge (15, 16) is formed by a step including application of roll means in said end region of at least one end of said inner pipe wall (12) to form said at least one bulge as a radially outwardly extending bulge.

3. The method of claim 1 wherein each of the two end regions of said inner wall (12) is formed with said at least one circumferentially extending bulge (15, 16).

4. The method of claim 1, wherein prior to forming of said at least one bulge includes the step of annealing the pipe blank (10) and subsequently removing the oxide layer formed thereby.

5. A method in accordance with the method as claimed in claim 1 wherein said at least one bulge (15, 16) is formed with relatively large radii of transition ($r_1$, $r_2$, $r_3$), especially in the transitional regions between said bulge (15, 16) and said inner pipe wall (12) and so that said bulge (15, 16) has a relatively shallow cross-section.

6. A pipe blank adapted to be filled with metal powder and subsequently hot worked to form a pipe member, comprising an inner wall, having a radial bulge in at least one end portion, an outer wall, a first closure secured to said inner wall and outer wall to close the corresponding end, and a removal end cover secured to said inner wall and outer wall to close the second end.

7. The pipe blank of claim 6 wherein said inner wall has said radial bulge in both end portions.

8. The pipe blank of claim 7 wherein each of said bulges includes large radii of transition ($r_1$, $r_2$, $r_3$), especially in the transitional regions between said bulge (15, 16) and said inner pipe wall (12) and so that said bulge (15, 16) has a relatively shallow cross-section.

* * * * *

UNITED STATES PATENT AND TRADEMARK OFFICE

CERTIFICATE OF CORRECTION

PATENT NO. : 4,584,170

DATED : April 22, 1986

INVENTOR(S) : CHRISTER ASLUND ET AL

It is certified that error appears in the above-identified patent and that said Letters Patent is hereby corrected as shown below:

Column 1, line 14, delete "power" and substitute therefore ---powder---

Column 3, line 6, after "with" delete "a" and substitute therefor ---at---

Signed and Sealed this

Eleventh Day of November, 1986

*Attest:*

DONALD J. QUIGG

*Attesting Officer* *Commissioner of Patents and Trademarks*